US009303406B2

(12) United States Patent
Sorkin

(10) Patent No.: US 9,303,406 B2
(45) Date of Patent: Apr. 5, 2016

(54) MODIFIED PERMANENT CAP

(71) Applicant: Felix Sorkin, Stafford, TX (US)

(72) Inventor: Felix Sorkin, Stafford, TX (US)

( * ) Notice: Subject to any disclaimer, the term of this patent is extended or adjusted under 35 U.S.C. 154(b) by 0 days.

(21) Appl. No.: 14/549,037

(22) Filed: Nov. 20, 2014

(65) Prior Publication Data

US 2015/0330076 A1 Nov. 19, 2015

Related U.S. Application Data

(60) Provisional application No. 62/000,396, filed on May 19, 2014.

(51) Int. Cl.
*E04C 5/08* (2006.01)
*E04C 5/12* (2006.01)
*E04B 1/16* (2006.01)

(52) U.S. Cl.
CPC .... *E04C 5/12* (2013.01); *E04B 1/16* (2013.01)

(58) Field of Classification Search
CPC ..... E04C 5/08; E04C 5/12; E04C 5/122; E04C 5/163; E04C 5/20
See application file for complete search history.

(56) References Cited

U.S. PATENT DOCUMENTS 4,053,974 A * 10/1977 Howlett et al. ..... 29/452
4,343,122 A * 8/1982 Wlodkowski et al. ..... 52/223.13
4,560,226 A * 12/1985 Dennis ..... 439/395
4,616,458 A * 10/1986 Davis et al. ..... 52/223.13
4,719,658 A * 1/1988 Kriofske ..... 52/223.13
4,773,198 A * 9/1988 Reinhardt ..... 52/223.13
4,896,470 A 1/1990 Sorkin
4,918,887 A * 4/1990 Davis et al. ..... 52/223.13
5,058,469 A * 10/1991 Rodriguez ..... 83/13
5,072,558 A 12/1991 Sorkin et al.
5,079,879 A * 1/1992 Rodriguez ..... 52/223.13
5,347,777 A * 9/1994 Sudduth ..... 52/223.13
5,440,842 A 8/1995 Sorkin
5,630,301 A * 5/1997 Sieg ..... 52/223.13
5,701,707 A 12/1997 Sorkin
5,720,139 A 2/1998 Sorkin
5,749,185 A 5/1998 Sorkin
5,755,065 A 5/1998 Sorkin
5,770,286 A 6/1998 Sorkin
5,788,398 A 8/1998 Sorkin
5,839,235 A 11/1998 Sorkin (Continued)

FOREIGN PATENT DOCUMENTS

DE 1784420 A 1/1972
GB 1082799 A 9/1967

OTHER PUBLICATIONS

International Search Report and Written Opinion issued in International Application No. PCT/US14/66626, dated Mar. 10, 2015 (7 pages).

*Primary Examiner* — Brian Glessner
*Assistant Examiner* — Gisele Ford
(74) *Attorney, Agent, or Firm* — Adolph Locklar

(57) ABSTRACT

A permanent stressed end cap for a post tensioned concrete member includes a grout retention feature adapted to retain a filler material within a void formed by a pocket former. The grout retention feature may be a generally knob or mushroom shaped, hex-headed, or square body extending from the cap. The grout retention feature may include one or more protrusions extending from the exterior of the cap. The grout retention feature may include one or more surface textures on the exterior of the cap.

9 Claims, 5 Drawing Sheets

(56) References Cited

U.S. PATENT DOCUMENTS

| | | | | |
|---|---|---|---|---|
| 5,897,102 | A * | 4/1999 | Sorkin | 254/29 A |
| 6,012,867 | A | 1/2000 | Sorkin | |
| 6,017,165 | A | 1/2000 | Sorkin | |
| 6,023,894 | A | 2/2000 | Sorkin | |
| 6,027,278 | A | 2/2000 | Sorkin | |
| 6,098,356 | A | 8/2000 | Sorkin | |
| 6,151,850 | A | 11/2000 | Sorkin | |
| 6,176,051 | B1 | 1/2001 | Sorkin | |
| 6,234,709 | B1 | 5/2001 | Sorkin | |
| 6,354,896 | B1 * | 3/2002 | Morita et al. | 445/23 |
| 6,381,912 | B1 | 5/2002 | Sorkin | |
| 6,513,287 | B1 | 2/2003 | Sorkin | |
| 6,557,317 | B2 | 5/2003 | Sorkin | |
| 6,560,939 | B2 | 5/2003 | Sorkin | |
| 6,578,329 | B1 * | 6/2003 | Stubler et al. | 52/223.14 |
| 6,631,596 | B1 | 10/2003 | Sorkin | |
| 6,761,002 | B1 | 7/2004 | Sorkin | |
| 6,817,148 | B1 | 11/2004 | Sorkin | |
| 6,843,031 | B1 * | 1/2005 | Sorkin | 52/223.13 |
| 7,424,792 | B1 | 9/2008 | Sorkin | |
| 7,596,915 | B2 * | 10/2009 | Lee et al. | 52/223.6 |
| 7,676,997 | B1 | 3/2010 | Sorkin | |
| 7,797,895 | B1 * | 9/2010 | Sorkin | 52/223.13 |
| 7,823,345 | B1 * | 11/2010 | Sorkin | 52/223.13 |
| 7,841,061 | B1 | 11/2010 | Sorkin | |
| 7,841,140 | B1 * | 11/2010 | Sorkin | 52/223.13 |
| 7,856,774 | B1 * | 12/2010 | Sorkin | 52/223.13 |
| 7,950,196 | B1 * | 5/2011 | Sorkin | 52/223.13 |
| 7,950,197 | B1 * | 5/2011 | Sorkin | 52/223.13 |
| 8,065,845 | B1 * | 11/2011 | Sorkin | 52/223.13 |
| 8,069,624 | B1 * | 12/2011 | Sorkin | 52/223.13 |
| 8,087,204 | B1 | 1/2012 | Sorkin | |
| 8,756,885 | B1 * | 6/2014 | Mathews et al. | 52/223.13 |
| 2002/0083659 | A1 * | 7/2002 | Sorkin | 52/167.1 |
| 2002/0108329 | A1 * | 8/2002 | Bournand et al. | 52/223.13 |
| 2002/0178665 | A1 * | 12/2002 | Campbell | 52/223.13 |
| 2003/0159377 | A1 * | 8/2003 | Marshall | 52/223.13 |
| 2004/0139670 | A1 * | 7/2004 | Nieto et al. | 52/223.1 |
| 2004/0148880 | A1 * | 8/2004 | Hayes | 52/223.1 |
| 2004/0148881 | A1 * | 8/2004 | Hayes | 52/223.13 |
| 2005/0284049 | A1 * | 12/2005 | Hayes et al. | 52/223.13 |
| 2006/0096196 | A1 * | 5/2006 | Hayes et al. | 52/223.13 |
| 2006/0179742 | A1 * | 8/2006 | Mathews et al. | 52/223.13 |
| 2007/0221894 | A1 * | 9/2007 | Burtscher | 254/104 |
| 2009/0077913 | A1 * | 3/2009 | Sorkin | 52/223.13 |
| 2009/0205273 | A1 * | 8/2009 | Hayes et al. | 52/223.13 |
| 2010/0050546 | A1 * | 3/2010 | Maekawa et al. | 52/223.13 |
| 2010/0186340 | A1 * | 7/2010 | Nakamura | 52/684 |
| 2014/0026372 | A1 * | 1/2014 | Stubler et al. | 24/122.6 |
| 2014/0245678 | A1 * | 9/2014 | Mathews et al. | 52/223.13 |

* cited by examiner

MODIFIED PERMANENT CAP

CROSS-REFERENCE TO RELATED APPLICATIONS

This application is a non-provisional application which claims priority from U.S. provisional application No. 62/000,396, filed May 19, 2014, which in incorporated by reference herein in its entirety.

TECHNICAL FIELD/FIELD OF THE DISCLOSURE

The present disclosure relates to equipment for post-tensioned stressed concrete members.

BACKGROUND OF THE DISCLOSURE

Many structures are built using concrete, including, for instance, buildings, parking structures, apartments, condominiums, hotels, mixed-use, casinos, hospitals, medical buildings, government buildings, research/academic institutions, industrial, malls, bridges, pavement, tanks, reservoirs, silos, foundations, sports courts, and other structures.

Prestressed concrete is structural concrete in which internal stresses are introduced to reduce potential tensile stresses in the concrete resulting from applied loads; this can be accomplished by two methods—post-tensioned prestressing and pre-tensioned prestressing. In a post-tensioned member, the prestressing member is tensioned after the concrete has attained a specified strength. In post-tensioning applications, the prestressing assembly, commonly known as a tendon, may include for example and without limitation, anchorages, the prestressing member, and sheathes or ducts. For the purposes of this disclosure, the prestressing member will be referred to as a "cable", although one having ordinary skill in the art with the benefit of this disclosure will understand that the prestressing member could be any suitable material exhibiting tensile strength which can be elongated including, for example and without limitation, reinforcing steel, single or multi strand cable. One having ordinary skill in the art with the benefit of this disclosure will likewise understand that the prestressing member may be formed from a metal or composite without deviating from the scope of this disclosure. The tendon generally includes an anchorage at each end. The cable is generally fixedly coupled to a fixed anchorage positioned at one end of the tendon, the so-called "fixed-end", and is adapted to be stressed at the other anchor, the "stressing-end" of the tendon.

In order to allow access to the stressing-end of the tendon once the concrete member is poured, a pocket former may be utilized to, for example, prevent concrete from filling in the area between the stressing-end anchor and the concrete element used to form the concrete member. As understood in the art, the concrete element may be a form or mold into which concrete is poured or otherwise introduced into to give shape to the concrete as it sets or hardens thus forming the concrete member. Once the concrete has sufficiently hardened and the form is removed, the pocket former is removed from the concrete member. Generally, pocket formers are frustoconical in shape to, for example, allow for easier removal from the concrete member. Typically, once the tendon is stressed, the pocket formed by the pocket former is filled with a material such as a cementitious chloride-free grout or concrete to, for example, provide fire protection and corrosion protection.

SUMMARY

The present disclosure provides for a permanent cap for a post-tensioned concrete anchor positioned in a cavity in a concrete member. The permanent cap may include a cap body. The cap body may be adapted to couple to and fluidly seal to the post tensioned concrete anchor. The permanent cap may further include a grout retention feature adapted to retain a filling material within the cavity.

The present disclosure also provides for a method of forming a post-tensioned concrete member. The method may include positioning a post-tensioning tendon within a concrete element. The post-tensioning tendon may include a tension member, fixed anchor, and a stressing end anchor. The method may further include positioning a pocket former between the stressing end anchor and the concrete element. The pocket former may be adapted to form a void in the concrete between the stressing end anchor and the concrete element. The method may further include placing concrete into the concrete element such that the post-tensioning tendon and pocket former are encased in cement; removing the pocket former from the cement; and coupling a permanent stressed end cap to the stressing end anchor. The permanent stressed end cap may include a cap body. The cap body may be adapted to couple to and fluidly seal to the stressing end anchor. The permanent stressed end cap may also include a grout retention feature adapted to retain a filling material within the void. The method may further include filling the void with a filling material such that the filling material substantially fills the void around the grout retention feature.

BRIEF DESCRIPTION OF THE DRAWINGS

The present disclosure is best understood from the following detailed description when read with the accompanying figures. It is emphasized that, in accordance with the standard practice in the industry, various features are not drawn to scale. In fact, the dimensions of the various features may be arbitrarily increased or reduced for clarity of discussion.

DETAILED DESCRIPTION

Figure 1A:
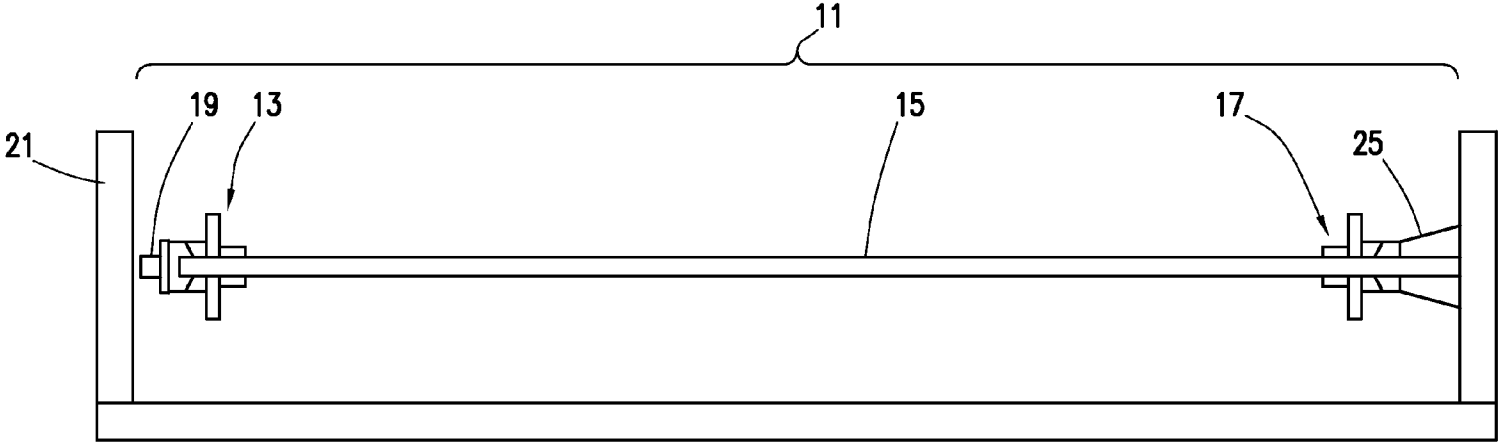
FIGS. 1*a-e* depict a partial cross section of a concrete pouring procedure consistent with embodiments of the present disclosure.

It is to be understood that the following disclosure provides many different embodiments, or examples, for implementing different features of various embodiments. Specific examples of components and arrangements are described below to simplify the present disclosure. These are, of course, merely examples and are not intended to be limiting. In addition, the present disclosure may repeat reference numerals and/or letters in the various examples. This repetition is for the purpose of simplicity and clarity and does not in itself dictate a relationship between the various embodiments and/or configurations discussed.

Figure 1B:
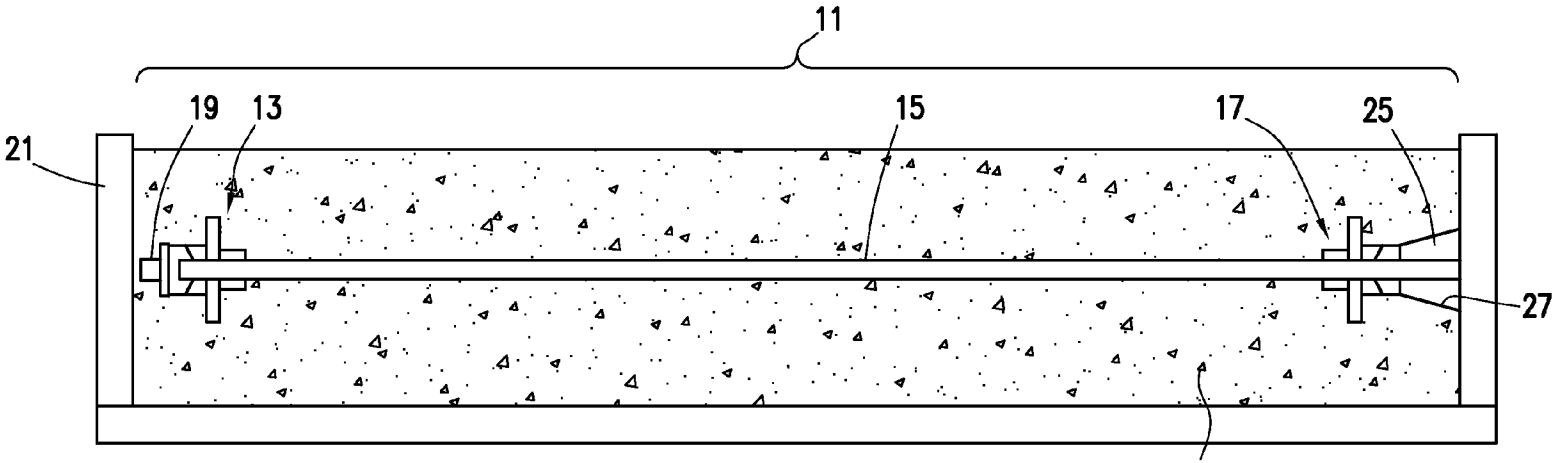

When stressing post-tensioned concrete members, anchoring systems may be provided to hold the post-tensioning tendon both before and after stressing. In some embodiments, as depicted in FIGS. 1*a-b*, post-tensioning tendon 11 may be positioned within concrete element 21. Post-tensioning tendon 11 may include for example and without limitation fixed end anchor 13, tension member 15, and stressing end anchor 17. In some embodiments, post-tensioning tendon 11 may also include a sheath (not shown) positioned about tension member 15 and one or more seals (not shown) between the sheath and each anchor. The sheath and seals may, for example, protect tension member 15 from corrosion after concrete 23 (shown in FIG. 1*b*) is poured. Additionally, the sheath and seals may, for example, prevent concrete from ingressing into tension member 15 and preventing or retarding its tensioning as discussed below. In some embodiments, a seal for fixed end anchor 13 may be omitted. As depicted in FIG. 1*a*, in some embodiments, fixed end anchor 13 may be positioned within concrete element 21 such that it will be completely encased in concrete 23. In some embodiments, fixed end cap 19 may be positioned at the end of fixed end anchor 13 to, for example, protect tension member 15 from corrosion after concrete 23 is poured.

Stressing end anchor 17 may be positioned within concrete element 21 such that it is substantially surrounded by concrete 23. Pocket former 25 may be positioned between the end of stressing end anchor 17 and concrete element 21. Pocket former 25 may be adapted to, for example and without limitation, prevent concrete 23 from filling the space between stressing end anchor 17 and the edge of the resultant concrete member formed by concrete 23 within form 21. Pocket former 25 may thus allow access to tension member 15 from without the concrete member once it is sufficiently hardened and concrete element 21 is removed.

Figure 1C:
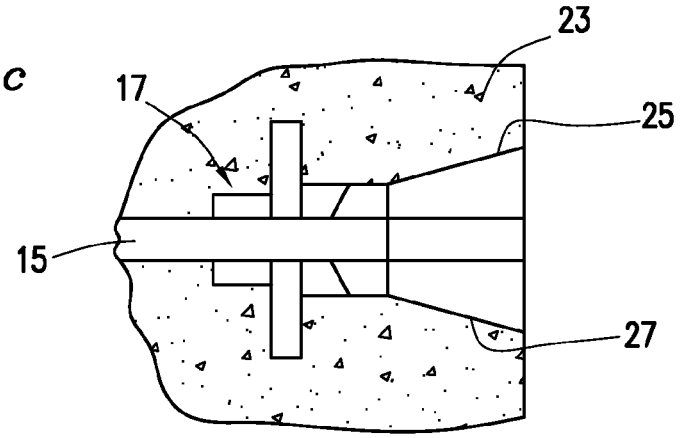
Figure 1D:
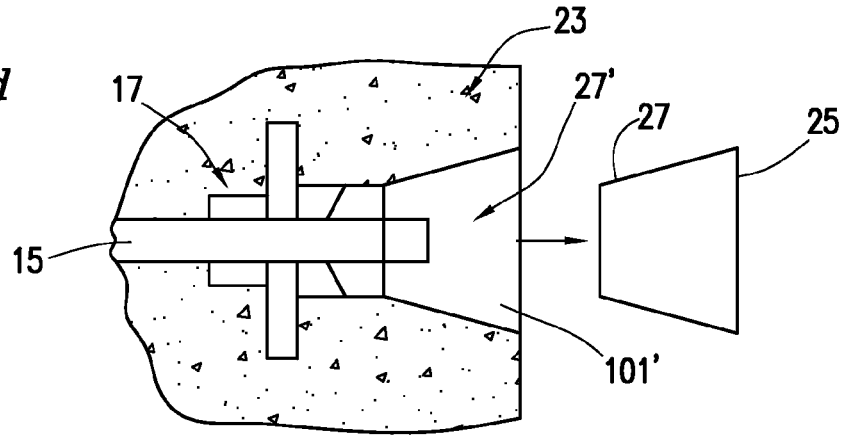
Figure 1E:
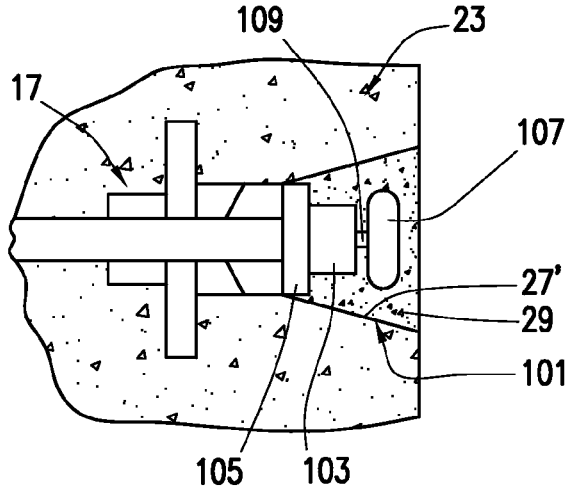

In some embodiments, as depicted in FIG. 1*c*, pocket former 25 may include pocket former body 27. In some embodiments, pocket former body 27 may include a coupler (not shown) for coupling pocket former 25 to stressing end anchor 17. In some embodiments, pocket former body 27 may be generally hollow. As depicted in FIGS. 1*c-e*, pocket former body 27 may be frustoconical. In some embodiments, by tapering pocket former body 101 inward from the edge of concrete 23, removal of pocket former body 27 from concrete 23 may, for example and without limitation, be accomplished more easily. As depicted in FIG. 1*d*, when pocket former body 27 is removed from concrete 23 (once concrete 23 has reached a sufficient strength), cavity 27' is left in concrete 23 corresponding with the outside shape of pocket former body 27.

In some embodiments, once pocket former body 27 is removed from concrete 23, tension member 15 may be placed under tensile stress. In some embodiments, stressing end anchor 17 may be adapted to allow tension member 15 to extend in length and be stressed against fixed end anchor 13 (now embedded in cement 23), while preventing retraction of tension member 15 once stressed. In some embodiments, tension member 15 may be cut to length such that it does not, for example, extend beyond the edge of concrete 23. In some embodiments, once sufficient tension has been applied, cavity 27' may, as depicted in FIG. 1*e*, be filled with filling material 29. Filling material 29 may, as understood in the art, be grout, a cementitious chloride-free grout, or concrete. In some embodiments, permanent stressed end cap 101 may be installed over the end of tension member 15 to, for example and without limitation, prevent filling material 29 from entering stressed end anchor 17 and tension member 15.

In some embodiments, permanent stressed end cap 101 may include cap body 103. Cap body 103 may be generally cylindrical in shape, although one having ordinary skill in the art with the benefit of this disclosure will understand that cap body 103 may be any shape. In some embodiments, cap body 103 may be generally hollow, allowing cap body 103 to fit over the end of tension member 15. In some embodiments, cap body 103 may be filled with grease. In some embodiments, permanent stressed end cap 101 may include coupler 105 adapted to couple permanent stressed end cap 101 to stressed end anchor 17. Coupler 105 may include, for example and without limitation, a threaded connection, press-fit connection, bayonet connection, or any other suitable coupler for coupling permanent stressed end cap 101 to stressed end anchor 17. In some embodiments, one or more seals (not shown) may be included to, for example, fluidly seal between stressed end cap 101 and stressed end anchor 17. In some embodiments, coupler 105 may be a separate part from stressed end cap 101 and installed to stressed end cap 101 and stressed end anchor 107 after stressed end cap 101 is in position.

In some embodiments, as depicted in FIG. 1*e*, permanent stress end cap 101 may include a grout retention feature 107. Grout retention feature 107 may provide more surface area and/or one or more locking features into which filling material 29 may fill, thus, for example and without limitation, preventing filling material 29 from delaminating or otherwise coming loose from or moving relative to concrete 23.

Figure 2A:
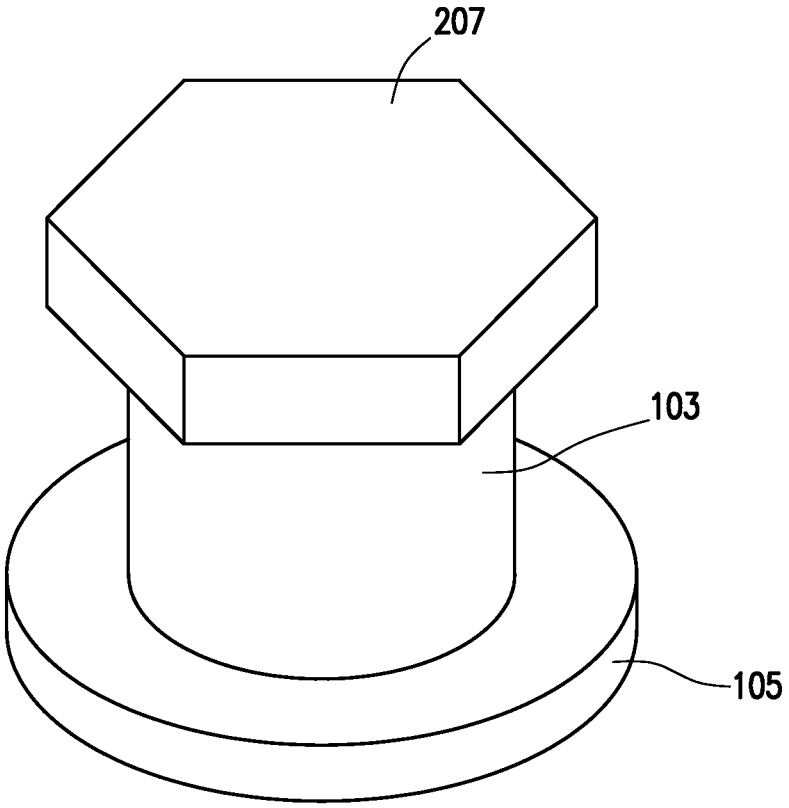
FIGS. 2*a-b* depict a permanent cap consistent with embodiments of the present disclosure.
Figure 2B:
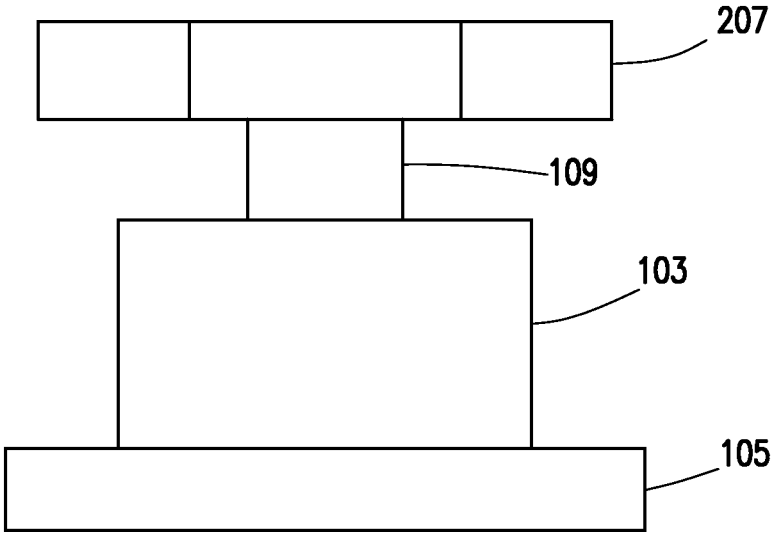
Figure 3:
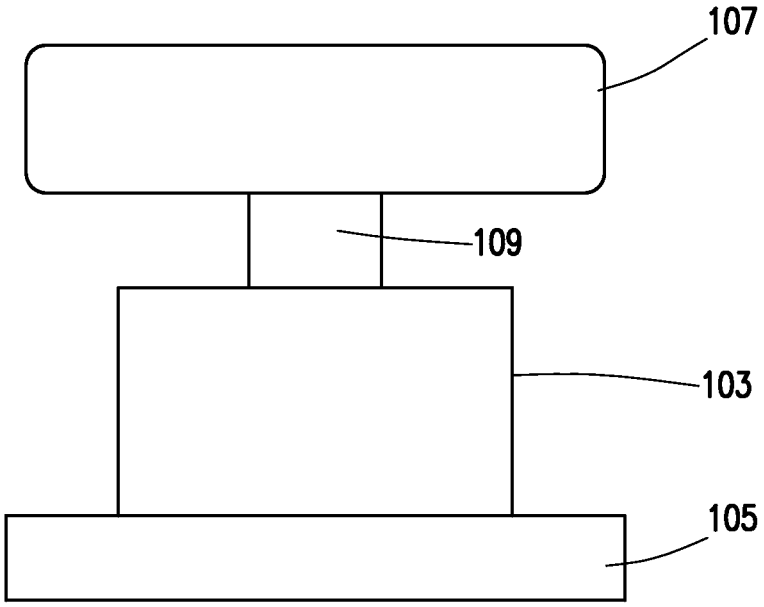
FIG. 3 depicts a permanent cap consistent with embodiments of the present disclosure.

As depicted in FIG. 1*e*, in some embodiments, grout retention feature 107 may extend past the end of cap body 103. As depicted in detail in FIG. 3, grout retention feature 107 may be coupled to cap body 103 by, for example and without limitation, neck 109. In some embodiments, grout retention feature 107 may be generally rounded or toroidal in shape as depicted in FIGS. 1*e*, 3. In some embodiments, as depicted in FIGS. 2*a*, 2*b*, grout retention feature 207 may be generally polygonal in shape. One having ordinary skill in the art with the benefit of this disclosure will understand that grout retention feature 107 may have any shape suitable for retaining filling material 29 within cavity 27', and may include without limitation, round, square, polygonal, mushroom-shaped, toroidal, ellipsoidal, spherical, or prismatoidal.

Figure 4:
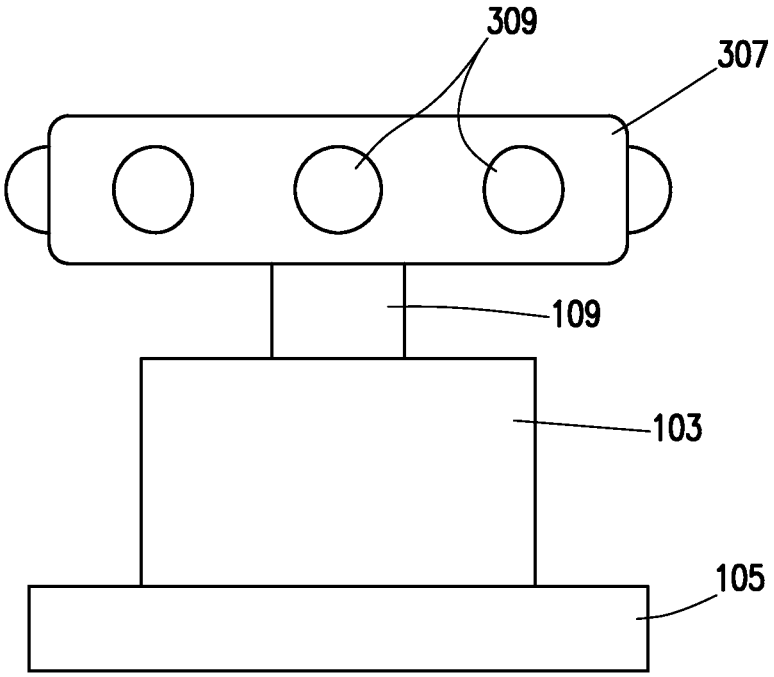
FIG. 4 depicts a permanent cap consistent with embodiments of the present disclosure.

In some embodiments, as depicted in FIG. 4, grout retention feature 307 may include one or more locking features. In some embodiments, locking features may include, for example and without limitation, textured surfaces, ridges, grooves, recesses, or protrusions from or into grout retention feature 307 adapted to prevent movement of filling material 29 relative to concrete 23. For example, FIG. 4 depicts multiple protrusions 309 extending from grout retention feature 307. One having ordinary skill in the art with the benefit of this disclosure will understand that protrusions 309 from grout retention feature 307 may be of any shape, including but not limited to, cylindrical, prismatoidal, ellipsoidal, or any combination thereof.

In some embodiments, grout retention feature 307 may further include a surface texture (not shown). One having ordinary skill in the art with the benefit of this disclosure will understand that the surface texture may be any pattern including but not limited to cross hatched, grooved, stippled, ridged, knurled, fluted, or any combination thereof. The surface texture may be formed as protrusions from grout retention feature 307, as depressions into grout retention feature 307, or any combination thereof.

Figure 5:
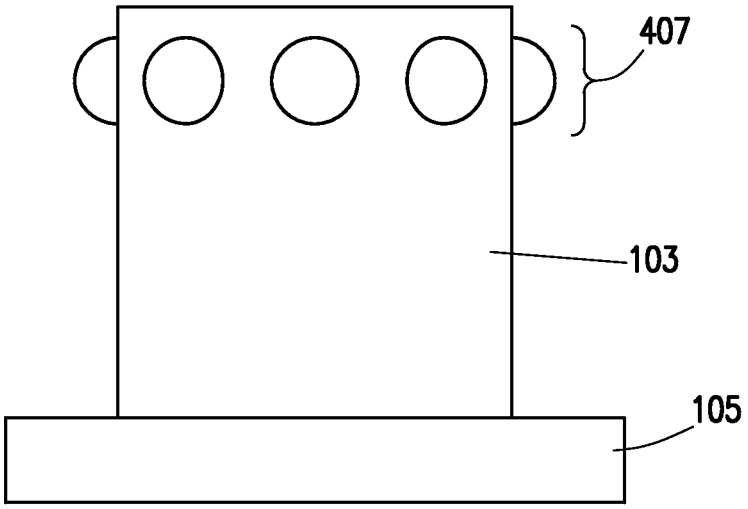
FIG. 5 depicts a permanent cap consistent with embodiments of the present disclosure.

In some embodiments, as depicted in FIG. 5, grout retention feature 407 may be formed as an integral part of cap body 103.

The foregoing outlines features of several embodiments so that a person of ordinary skill in the art may better understand the aspects of the present disclosure. Such features may be replaced by any one of numerous equivalent alternatives, only some of which are disclosed herein. One of ordinary skill in the art should appreciate that they may readily use the present disclosure as a basis for designing or modifying other processes and structures for carrying out the same purposes and/or achieving the same advantages of the embodiments introduced herein. One of ordinary skill in the art should also realize that such equivalent constructions do not depart from the spirit and scope of the present disclosure and that they may make various changes, substitutions, and alterations herein without departing from the spirit and scope of the present disclosure.

The invention claimed is:

1. A permanent cap for a post-tensioned concrete anchor positioned in a cavity in a concrete member comprising:

a cap body, the cap body adapted to couple to the post tensioned concrete anchor; and a grout retention feature adapted to retain a filling material within the cavity, the grout retention feature extending from an end of the cap body opposite the post-tensioned concrete anchor, the grout retention feature including a grout retention feature body coupled to the cap body by a neck.

2. The permanent cap of claim 1, wherein the grout retention feature body is prismatoidal in shape.

3. The permanent cap of claim 1, wherein the grout retention feature body is generally round or oblong.

4. The permanent cap of claim 1, wherein the grout retention feature body is a generally regular square or hexagonal prism.

5. The permanent cap of claim 1, wherein the grout retention feature comprises at least one protrusion.

6. The permanent cap of claim 5, wherein the protrusion comprises at least one of a cylindrical, prismatoidal, or ellipsoidal protrusion.

7. The permanent cap of claim 1, wherein the grout retention feature comprises a surface texture.

8. The permanent cap of claim 7, wherein the surface texture comprises at least one of cross hatches, grooves, stipples, ridges, knurls, flutes, or any combination thereof.

9. The permanent cap of claim 1, wherein the grout retention feature body is polygonal, mushroom-shaped, ellipsoidal, or spherical.

* * * * *